US006736649B1

(12) United States Patent
Fahllund

(10) Patent No.: US 6,736,649 B1
(45) Date of Patent: May 18, 2004

(54) VARIABLE TWO PART DC-JACK

(75) Inventor: Jan Fahllund, Turku (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/353,395

(22) Filed: Jan. 29, 2003

(51) Int. Cl.[7] ..... H01R 12/00
(52) U.S. Cl. ..... 439/79; 439/83
(58) Field of Search ..... 439/79, 83

(56) References Cited

U.S. PATENT DOCUMENTS 5,263,880 A * 11/1993 Schwarz et al. ..... 439/79
5,605,477 A * 2/1997 Wu et al. ..... 439/79
5,609,491 A * 3/1997 Cooper et al. ..... 439/79
6,095,865 A * 8/2000 Wu ..... 439/79
6,280,205 B1 * 8/2001 Murowaki et al. ..... 439/79

* cited by examiner

*Primary Examiner*—Tho D. Ta
(74) *Attorney, Agent, or Firm*—Harrington & Smith, LLP

(57) ABSTRACT

An electrical connector 30 has two major components: a frame 32 and a transition element 34. The frame defines an exterior surface 36, 37, 38, 40, 42, 72 and a cavity for receiving a plug. Conductive strips 44, 46 cover a portion of the frame exterior surface, and each strip is connected to a contactor within the cavity. Ribs 48, 74 may extend from sidewalls 36, 37, 38, 72 of the frame for mounting on a PWB. A major surface of the PWB may contact the ribs and intersect a rear wall 40. The transition element has spring contactors 52, 58 corresponding to the strips. A stationary segment 54, 60 of each spring contactor is fixed to the PWB, and an opposing free segment 56, 62 contacts a strip when the frame and transition element are assembled in a device. The free segments are biased to maintain contact with the strips.

20 Claims, 7 Drawing Sheets

VARIABLE TWO PART DC-JACK

TECHNICAL FIELD

These teachings relate generally to electrical connectors, and are particularly relevant to DC connectors of portable electronic devices such as mobile telephones and terminals, electronic organizers, music players, cameras, camcorders and portable computers for charging the batteries of those devices.

BACKGROUND

Portable electronic devices such as those mentioned above have continued to be reduced in size, putting a premium on the physical space within the devices themselves. However, manufacturers generally wish to retain compatibility of accessories (chargers, headsets, etc.) among numerous product models. This allows the same type of accessories to operate with newer more compact models as well as existing products already in use, and it also reduces the need for numerous models of accessories that are each compatible with only select models of a device. This desire for compatibility imposes the need to continue using jacks/electrical connectors that interface with accessories in newer, typically smaller device models that have been used in older models. The continuing trend toward smaller device models imposes a need for architectural flexibility in mounting and arranging those jacks.

Currently, jacks are typically a single-body or unitary design wherein the jack is mounted to a printed wiring or circuit board (PWB) within the device. Leads extend from within a cavity defined by the unitary jack, where a mating complementary plug may be received, through the jack housing. A portion of each lead extends beyond the jack housing, which is then soldered or otherwise fixedly connected to the PWB to complete electrical connectivity with the overall device. Many of the existing jack designs, especially power jacks for re-charging batteries that supply portable power the subject devices, are mounted to a major surface of the PWB. The major surfaces are the two opposed surfaces defining the greatest surface area of the PWB. This design complicates further size reductions of portable electronic devices for two reasons. First, their mounting position above or below the PWB limits placement of the jack within the device to locations where the housing spans the z direction sufficiently. In the convention of the industry, the z direction is normal to the two parallel planes defined by the major surfaces of the PWB and is graphically depicted at FIG. 1. Second, their unitary design imposes high cost in redesigning where the jack may be located along the PWB. Because the leads of the jack are fixed, even small changes to its location along a PWB require redesign of the PWB wiring architecture, and commensurate retooling for manufacture of the new device. These redesign inefficiencies remain even for currently existing jacks that are mounted through or along an edge of the PWB rather than above or below it.

What is needed in the art is a jack that retains compatibility with existing accessories but that allows more flexibility in physically locating and mounting the jack on a PWB or substrate without adding the current redesign inefficiencies. Preferably, such a jack would allow at least minor variations in placement relative to a PWB without the need to reconfigure the PWB itself. Ideally, the jack would also be mountable through a plane defined by a major surface of the PWB, rather than directly on one of those surfaces, to minimize extension in the z-direction.

SUMMARY OF THE PREFERRED EMBODIMENTS

The foregoing and other problems are overcome, and other advantages are realized, in accordance with the presently preferred embodiments of these teachings.

In accordance with the present invention, an electrical connector for a portable electronic device comprises a frame that defines an exterior surface and an electrically conductive first strip. The first strip is disposed on at least a portion of the exterior surface of the frame. The transition element comprises an electrically conductive first spring contactor, wherein the first spring contactor defines a stationary segment for contact with a substrate and an opposed free segment biased for contact with the first strip.

The present invention also includes a method of connecting an electrical connector to a PWB. The method comprises the steps of first providing a PWB; then fixedly attaching a transition element of the electrical connector to the PWB; and then fixedly attaching a frame of the electrical connector to a substrate so that a strip disposed on at least a portion of an exterior surface of the frame is in contact with a biased free end of the transition element. The substrate to which the frame is attached may or may not be the PWB to which the transition element is attached.

BRIEF DESCRIPTION OF THE DRAWINGS

The foregoing and other aspects of these teachings are made more evident in the following Detailed Description of the Preferred and Alternative Embodiments, when read in conjunction with the attached Drawing Figures, wherein.

DETAILED DESCRIPTION OF THE PREFERRED AND ALTERNATIVE EMBODIMENT

Figure 1:
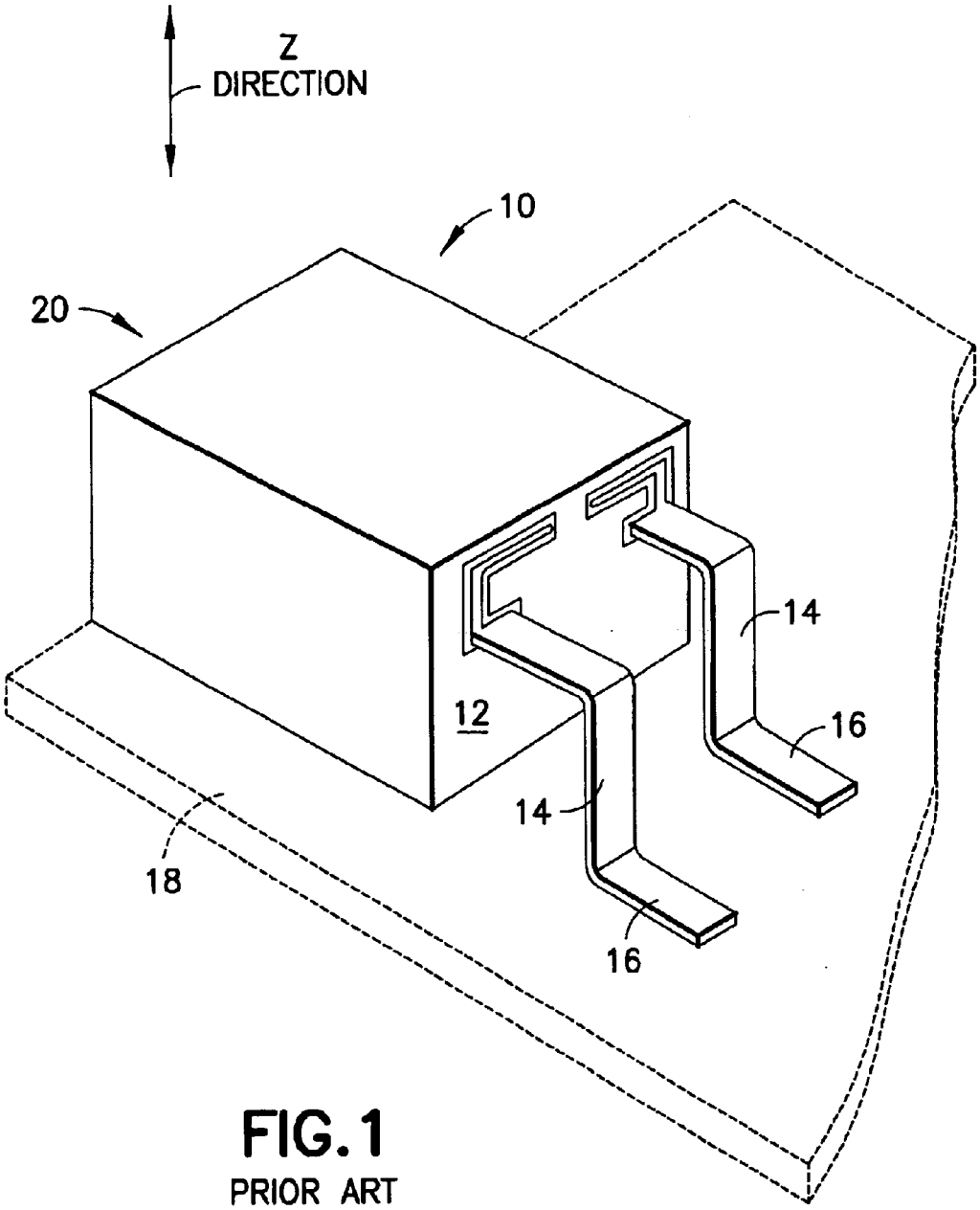
FIG. 1 PRIOR ART
FIG. 1 is a perspective view of a prior art jack embodying a unitary design.

This invention provides in one embodiment an electrical connector, receptacle or jack in two separate major components. By way of comparison, FIG. 1 depicts a single part or unitary jack 10 of the prior art, wherein the jack defines a rear wall 12 and a pair of unitary contactors 14 that pass through voids defined by the rear wall of the jack and extending therefrom. The unitary contactors 14 are soldered or otherwise fixedly connected at their respective free ends 16 to a printed wiring board (PWB) 18 or other suitable substrate in such a manner that a jack cavity defined by a receptacle end 20 is positioned to receive a complementary electrical connector or plug (not shown). Within the jack cavity, the unitary contactors are typically formed into contacts to mate with and connect electrically to the complimentary plug that may be inserted.

Figure 2:
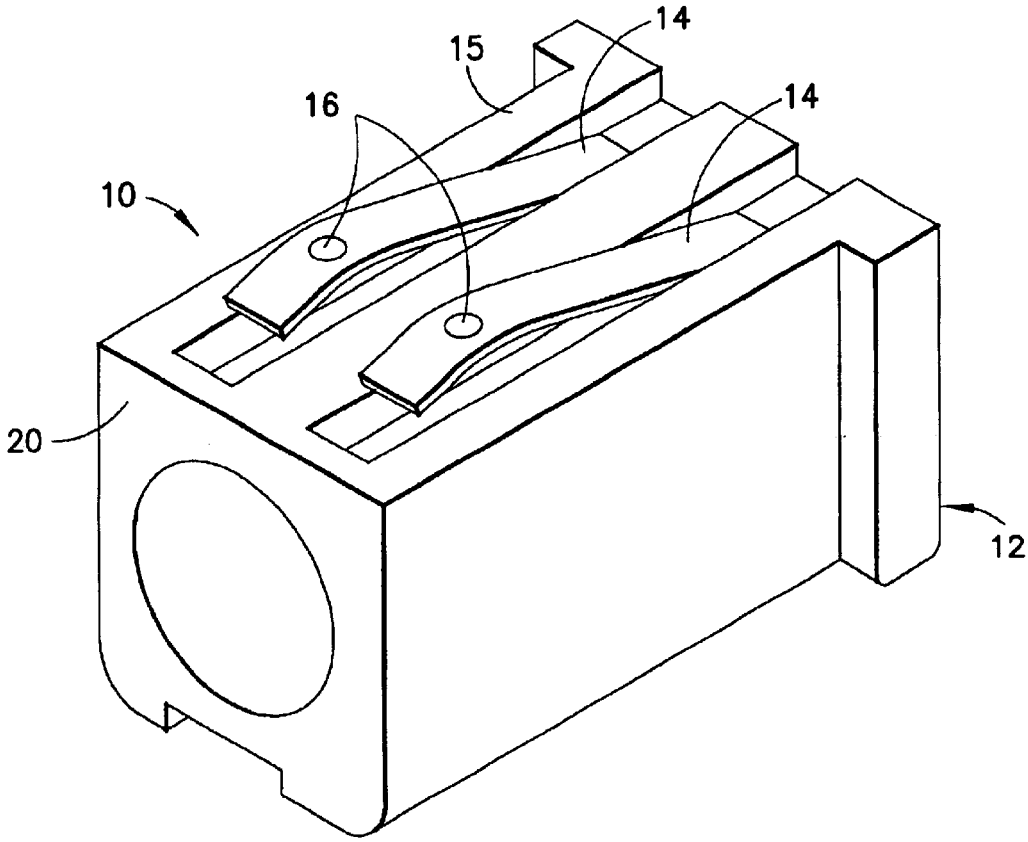
FIG.2 PRIOR ART
FIG. 2 is a perspective view of another prior art jack embodying a different unitary design.

FIG. 2 illustrates another jack 10 of the prior art viewed toward the receptacle end 20. The unitary contactors 14 extend above the top 15 (as depicted) of the jack and define free ends 16 that are biased to contact leads against which the jack may be mounted. The jacks of both FIG. 1 and FIG. 2 are limited in that they must be mounted onto a major surface of a PWB or via an additional adapter that may position the jack outboard of an edge of the PWB.

Figure 3:
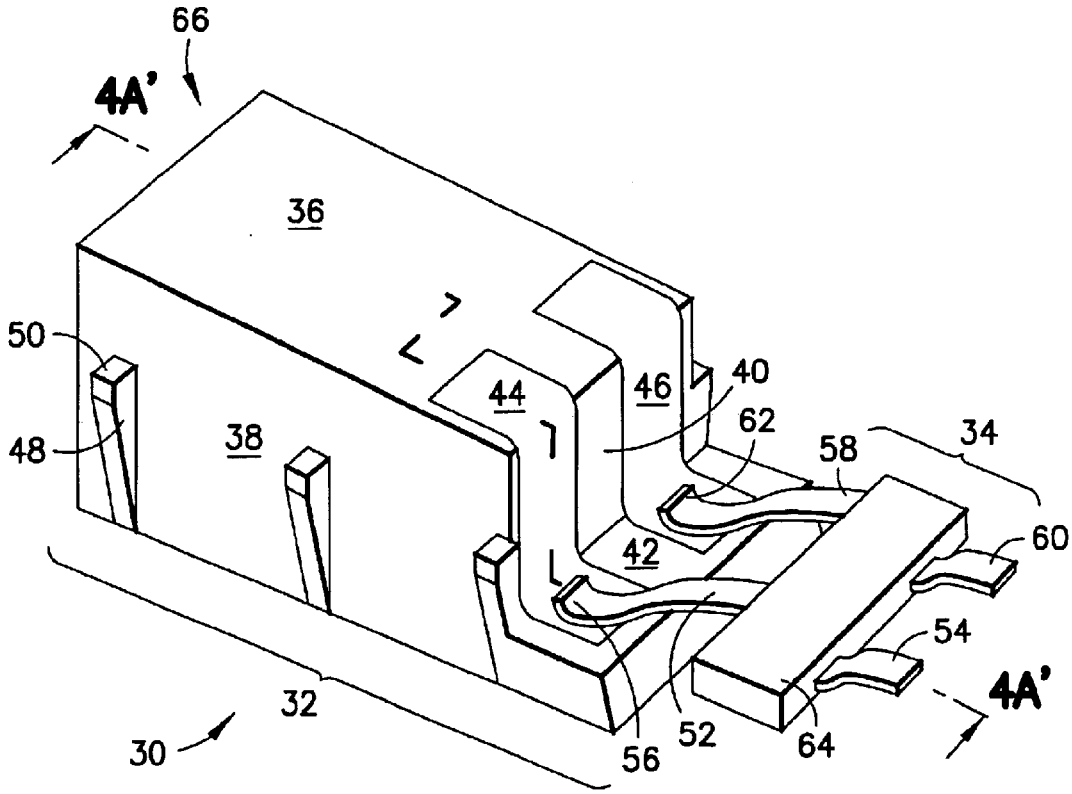
FIG. 3 is a perspective view of a two-part jack according to the preferred embodiment of the present invention.
Figure 4A:
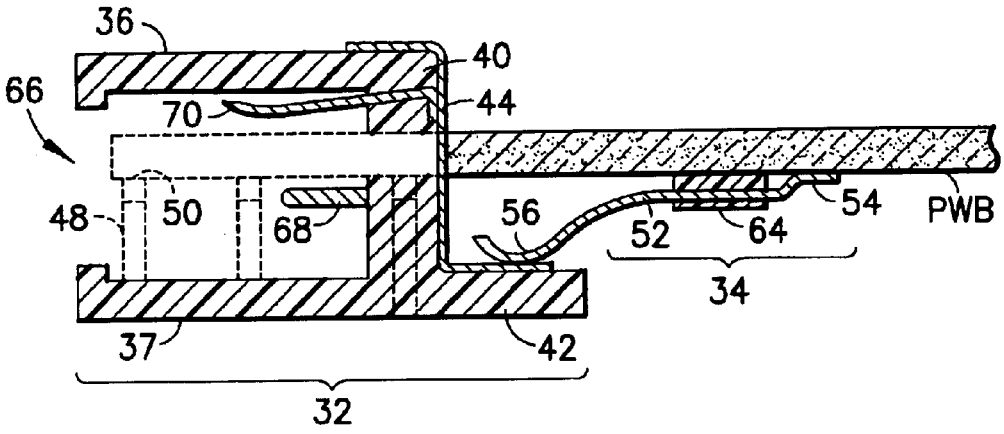
FIG. 4A is a sectional view of the jack of FIG. 3 mounted on a PWB, wherein the free ends contact the strips near the lip.

The preferred embodiment of the present invention is depicted in FIGS. 3 and 4A, wherein a jack 30 comprises two separate major components that come into contact when assembled in a finished product: a frame 32 and a transition element 34. The frame defines a first sidewall 36 and an opposing second sidewall 37. For convention with regard to this disclosure, the term sidewall shall indicate a top, a bottom, and/or a lateral wall of the frame, since the jack 30 may be mounted with the first sidewall 36 in an upright fashion to form a top as shown in FIG. 3, or rotated from that orientation so that the first sidewall 36 forms a lateral wall or a bottom. The frame further defines a third sidewall 38, an opposing fourth sidewall 72 (see FIGS. 5 and 6), and a rear wall 40. Extending from the rear wall is a lip 42, which in the preferred embodiment includes surfaces parallel to the first sidewall, the second sidewall, and the rear wall.

An electrically conductive first strip 44 is disposed on an exterior surface of the frame, preferably a portion of each of the first sidewall, the rear sidewall, and the lip. Preferably, the first strip is fixedly attached thereto. An electrically conductive second strip 46 is similarly disposed and spaced from the first strip sufficiently to prevent electrical contact or arcing in the operational voltage and current ranges expected.

Extending from the third sidewall 38 is a first rib 48 that defines a first mounting surface 50. Preferably there are three such ribs extending from each of the third sidewall and the fourth sidewall, aligned in such a manner that each of the mounting surfaces lie in the same plane. When the frame is attached to a PWB, the mounting surfaces abut a face of the PWB to ensure proper alignment of the frame with respect to the transition element and to the overall electronic device in which the jack is mounted. However, there may be instances wherein the jack is mounted in a canted orientation, in which case a plane defined by mounting surfaces associated with the third sidewall may not be coincident with a plane defined by the mounting surfaces associated with the fourth sidewall.

The second major component of the jack 30 is the transition element 34, which functions to electrically connect portions of the frame 32 to the PWB or other substrate. The transition element comprises an electrically conductive first spring contactor 52 that defines a first stationary segment 54 or stationary end and an opposing first free segment 56 or free end. Stationary element as used herein does not connote immoveable. The first stationary segment is soldered or otherwise fixedly connected to an appropriate contact on the PWB, and the free segment is spring biased (preferably by its shape and the resiliency of the underlying material from which it is made, or alternatively by other biasing means) to contact the first strip 44 of the frame. The first free segment may additionally be fixedly connected to the first strip once the major components of the jack are attached to a substrate without departing from the broader aspects of the present invention. Such an adaptation may be desirable to more positively assure electrical contact during extremely rough handling of the overall electronic device, for example.

A second spring contactor 58 defines a second stationary segment 60 or stationary end and an opposing second free segment 62 or free end, similar to the first spring contactor. The first and second spring contactors 52 and 58 are spaced from each other sufficiently to prevent electrical contact or arcing in the operational voltage and current ranges expected. For ease of assembly with a PWB, the first and second spring contactors are preferably disposed in and spaced from each other by a mounting block 64. The jack is preferably mounted to and electrically connected with a PWB as follows. The mounting block of the transition element is fixedly attached to the PWB, typically via an adhesive. The first and second stationary segments 54 and 60 are soldered to appropriate contacts disposed on the PWB. The frame is brought into contact with the PWB by abutting the mounting surface(s) 50 against a surface of the PWB, and securing the frame to the PWB in such a manner that the first strip 44 abuts and electrically contacts the first free segment 56 of the first spring contactor 52 and the second strip 46 abuts and electrically contacts the second free segment 62 of the second spring contactor 58.

Figure 4B:
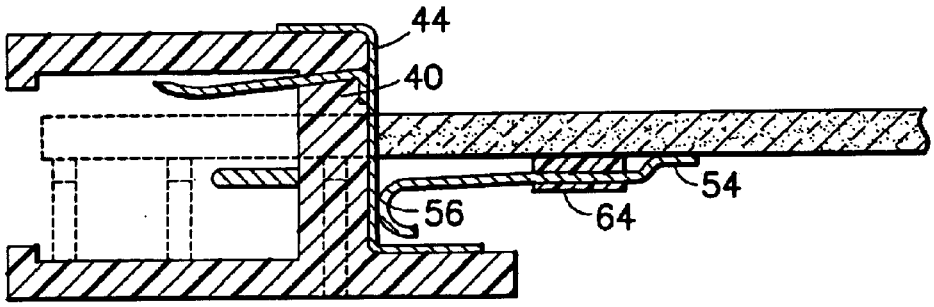
FIG. 4B is similar to FIG. 4A but depicting a first alternate embodiment, wherein the free ends contact the strips near the rear wall.
Figure 4C:
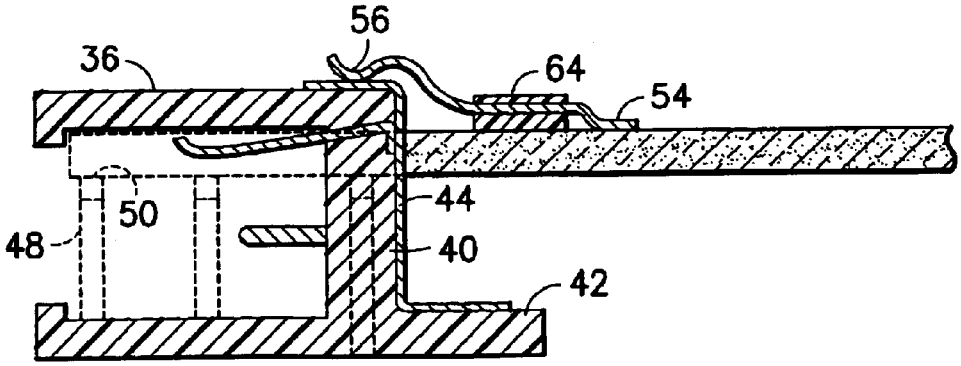
FIG. 4C is similar to FIG. 4A but depicting a second alternate embodiment, wherein the free ends contact the strips near a sidewall.

FIG. 4A depicts a sectional view of FIG. 3 taken through section line 4A'—4A', and exposes the cavity defined by the receptacle end 66 of the frame through which a complimentary connector or plug (not shown) may be received. Also visible in FIG. 4A is an axial contactor 68 and a peripheral contactor 70 for electrically connecting with such a plug. The peripheral contactor 70 passes through the rear wall 40 and is shown in electrical contact with the first strip 44. In practice, manufacturers typically make a single conductive element that passes from inside the receptacle cavity to exterior of the connector housing. FIGS. 4A–4C depict two-piece construction to better illustrate the strips 44 and 46. Similarly but not shown, the axial contactor 68 passes through the rear wall and is in electrical contact with the second strip 46. The choice of which contactor 68 or 70 is in electrical contact with which strip 44 or 46 is arbitrary. Also shown in FIGS. 4A–4C are hidden line extensions of the PWB through the frame and hidden lines depicting ribs that abut the PWB. The major surfaces of the PWB are depicted therein as horizontal.

FIG. 4B depicts a first alternate embodiment wherein the connection between the first free segment 56 and the first strip 44 varies from that shown in FIG. 4A. Specifically, the first free segment abuts against the portion of the first strip that lies against the rear wall 40 of the frame. In each of FIGS. 4A and 4B, extension of the jack in the z direction is minimized.

FIG. 4C depicts a second alternate embodiment, again varying the connection between the first free segment 56 and the first strip 44 as compared to those shown previously. In this embodiment, the transition element 34 is mounted above the PWB as opposed to below it. The first free segment 56 abuts a portion of the first strip 44 that is adjacent to the first sidewall 36, rather than in the rear wall or lip areas. The second free segment contacts the second strip in a similar location. Unlike FIGS. 4A and 4B, the mounting block 64 is affixed to the surface of the PWB opposite the lip 42.

Also evident in FIG. 4C is the ease with which the frame 32 of the present invention may be mounted at varying elevations in the z-direction with respect to the PWB. Preferably the ribs 48 are molded into the third and fourth sidewalls of the frame, and are therefore not adjustable in a given jack. However, efficiently implementing changes to an injection-molded structure depend largely upon where on the structure the changes are to be made. Apart from jacks mounted on a surface of a PWB, previous jacks used by the assignee of the present application were molded to mount outboard of the PWB. Changing the z-elevation of such outboard mounted jacks required entirely new injection molds. The frame structure of the present invention, specifically the ribbed sidewalls, may accommodate changes in the jack's z-elevation mounting position by merely changing ejector pins in an injection molding machine, rather than requiring new molds. This would result in a much more efficient process, both in cost and time.

Figure 5:
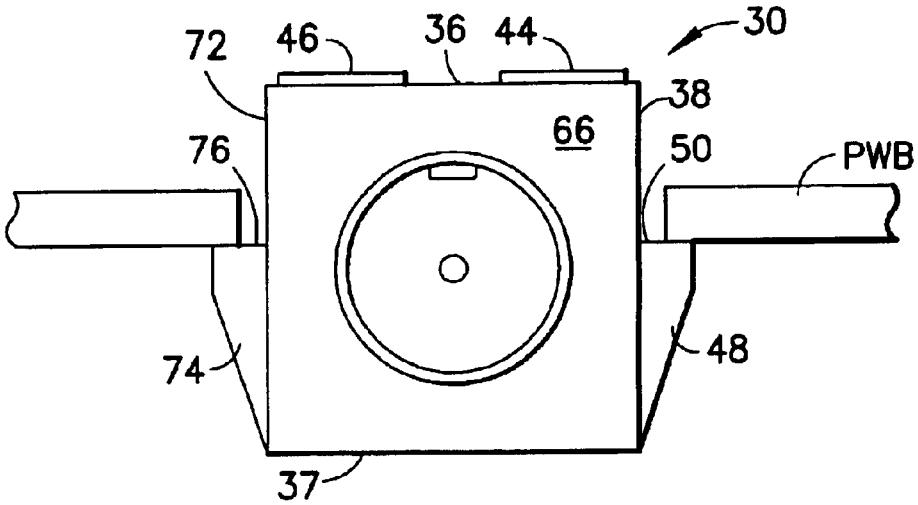
FIG. 5 is a view of the receptacle end of the jack of FIG. 3 mounted on a PWB.

FIG. 5 depicts the frame 32 of the present invention mounted on a PWB as viewed looking towards the receptacle end 66. This illustration better shows the relation of the PWB with the first rib 48 and first mounting surface 50 associated with the third sidewall 38, as well as that with the second rib 74 and the second mounting surface 76 associated with the fourth sidewall 72. This illustration also more clearly shows that the frame may be mounted through a cutout in the PWB, rather than on its surface or outboard an edge of the PWB as has been the present assignee's prior practice.

Figure 6:
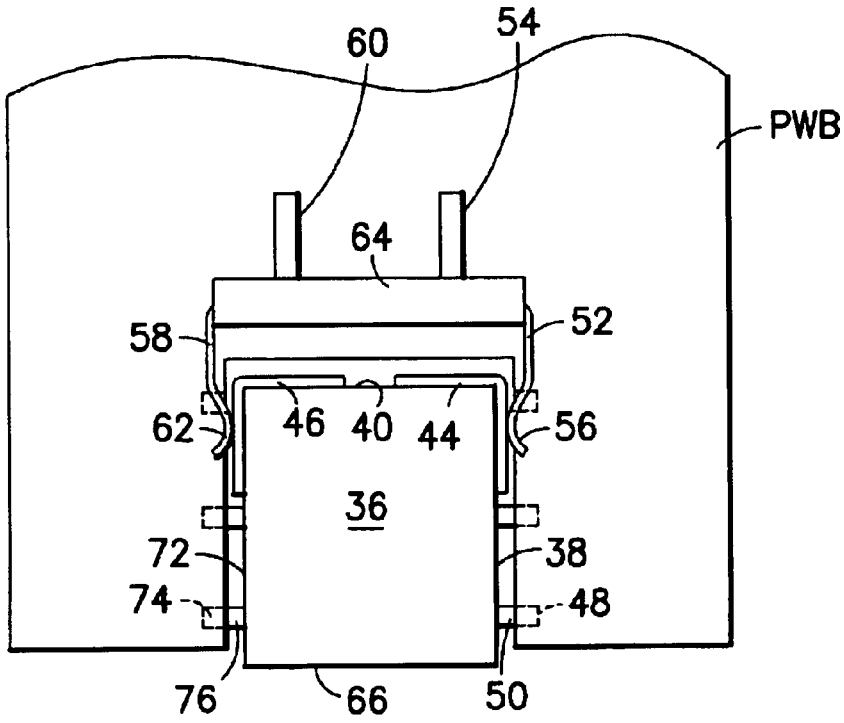
FIG. 6 is a top view of the jack mounted on a PWB depicting a third alternate embodiment, wherein each strip is disposed on the rear wall and an opposing sidewall.

FIG. 6 depicts a top view of the third alternate embodiment, wherein the mounting block 64 is affixed to the upper surface of the PWB. The first strip 44 is disposed on the rear wall 40 and the third sidewall 38. The second strip is disposed on the rear wall 40 and the fourth sidewall 72. The transition element is commensurately modified as compared to previous embodiments. Specifically, the first free segment 56 of the first spring contactor 52 abuts the first strip 44 in an area adjacent to the third sidewall 38. Similarly, the second free segment 62 of the second spring contactor 58 abuts the second strip 46 in an area adjacent to the fourth sidewall 72. This embodiment provides the dual advantages of minimal extension in the z-direction and the potential for a strong bias of the free segments 56 and 62 to maintain contact against the strips 44 and 46. However, it imposes the manufacturing difficulty of requiring a ninety-degree twist in each of the spring contactors 52 and 58. The embodiment of FIG. 6 dictates that major surfaces of the free segments lie in a plane normal to the page of FIG. 6, while the stationary segments 54 and 60 lie in a plane parallel to the page in order to maximize contact area with the strips and the PWB, respectively.

Figure 7A:
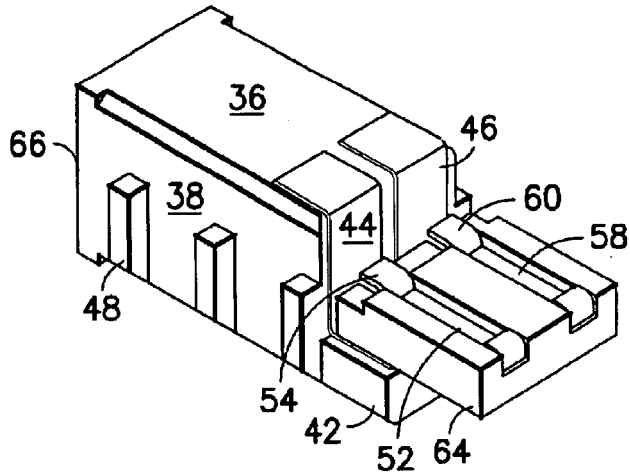
FIG. 7A is a perspective view of a fourth alternate embodiment employing a spring-type transition element comprising two contactors.
Figure 7B:
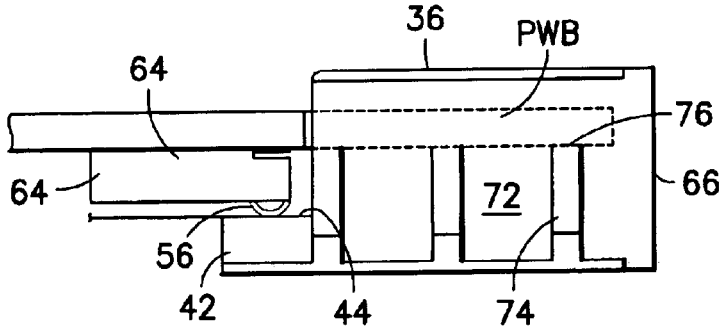
FIG. 7B is a side view of the jack of FIG. 7A showing its relation to a PWB.
Figure 7C:
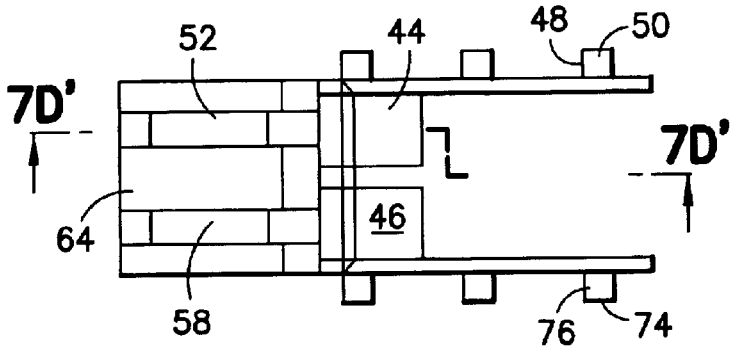
FIG. 7C is a top view of the jack of FIG. 7A.
Figure 7D:
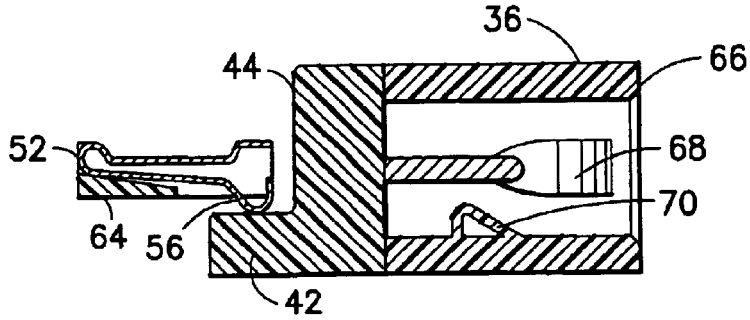
FIG. 7D is a sectional view of the jack of FIG. 7C.

FIGS. 7A–7D illustrate a fourth alternate embodiment, wherein the transition element comprises two spring type contactors. FIG. 7A shows in perspective view the two components, frame and transition element, as assembled. FIG. 7B shows a side view of the jack in relation to a PWB. FIG. 7C is a top view, and FIG. 7D is a section view taken along line 7D'—7D' of FIG. 7C. The frame in this embodiment is identical to that of FIG. 4A, wherein the rear wall 40 opposes the receptacle end, the first sidewall 36 is oriented at the top, and a plurality of ribs including the first rib 48 defining a first mounting surface 50 extend from the third sidewall 38. The transition element differs in that the first spring contactor 52 and the second spring contactor 58 wraps around and through the mounting block 64 rather than passing straight through as in previous embodiments. This is best illustrated in FIG. 7D, wherein the first spring contactor 52 defines a first stationary segment 54 and a first free segment 56 that are disposed proximal to one another. The free segments are biased to contact the strips as in previous embodiments. The stationary segments may include a slight bias in this embodiment to assure positive contact with the PWB.

Figure 8A:
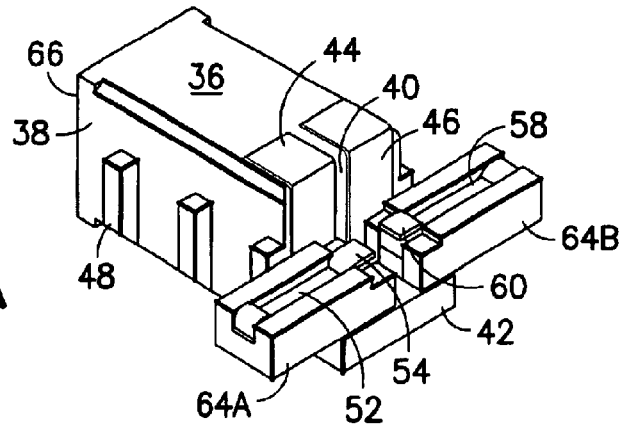
FIG. 8A is a perspective view of a fifth alternate embodiment employing two spring-type transition element, each transition element comprising one contactor.
Figure 8B:
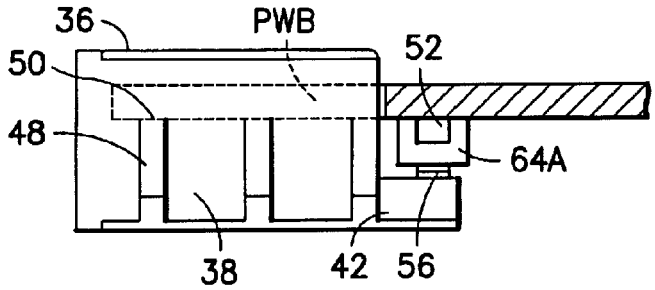
FIG. 8B is a side view of the jack of FIG. 8A showing its relation to a PWB.
Figure 8C:
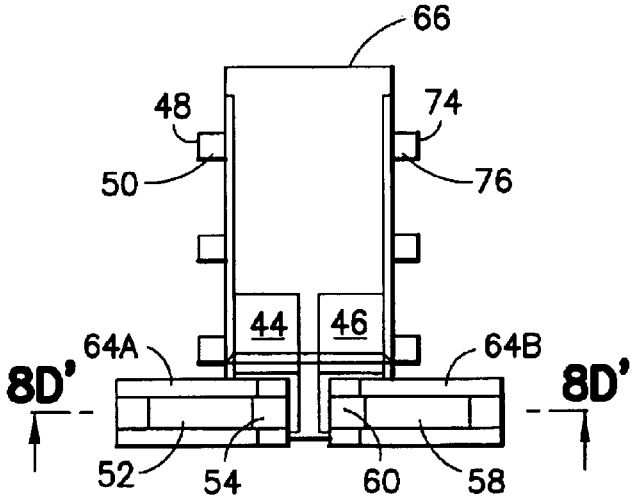
FIG. 8C is a top view of the jack of FIG. 8A.
Figure 8D:
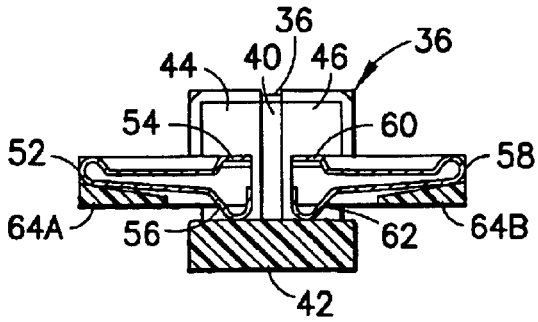
FIG. 8D is a sectional view of the jack of FIG. 8C.

FIGS. 8A–8D illustrate a fifth alternate embodiment, wherein two transition elements each carry a single spring type contactor. FIG. 8A shows in perspective view the frame and transition elements as assembled, wherein the mounting blocks are designated 64A and 64B. FIG. 8B shows a side view of the jack in relation to a PWB. FIG. 8C is a top view, and FIG. 8D is a section view taken along line 8D'—8D' of FIG. 8C. The frame in this embodiment is identical to that of FIGS. 7A–7D described above. The transition elements of FIGS. 8A–8D are identical to one another, and each include a mounting block 64 through which either a first spring contactor 52 or the second spring contactor 58 wraps, similar to that of FIGS. 7A–7D. A comparison of FIG. 8D with FIG. 7D shows the similarity. The two transition elements of FIGS. 8A–8D may be oriented parallel to one another to achieve an alignment substantially as shown in FIGS. 7A–7D, or they may be opposed as depicted in FIGS. 8A–8D. The free segments are biased to contact the strips near the lip, and broad strips (as depicted throughout) allow a designer the flexibility to orient the two transition elements in either of the proposed positions.

The above illustrations exemplify the variety of connection options available with the jack of the present invention. From a manufacturing perspective, the frame of FIG. 4A may remain unchanged while the smaller and less complex transition element may be easily varied to allow greater latitude in efficiently redesigning the jack location relative to the PWB. In fact, every embodiment depicted herein, except that of FIG. 6, employs the same frame style. Modifications to the frame to shift its mounting position in the z-direction are less prohibitive than previous models used by the present assignee. The strips may be mounted to one or any number and combination of frame surfaces to further maximize design flexibility without reconfiguring major portions of the PWB. Furthermore, the above disclosure is not limited to the frame being mounted to the PWB. Because the jack is in two parts that need not have a soldered connection between them, it may be prudent in certain applications to mount the frame directly to a housing of a portable electronic device so that when the housing is sealed, proper contact is made between the frame and the transition element as described above. Due to the present inventions potential for a solderless connection, the frame can be mounted to any suitable substrate. This disclosure and the ensuing claims therefore do not limit the term substrate to a PWB or a device housing but includes any suitable mounting surface or body.

Thus, while this invention has been particularly shown and described with respect to certain preferred and alternative embodiments thereof, it will be understood by those skilled in the art that changes in form and details may be made therein without departing from the scope and spirit of these teachings.

What is claimed is:

1. An electrical connector for a portable electronic device comprising:

a frame defining an exterior surface and an electrically conductive first strip disposed on at least a portion of the exterior surface, and a transition element comprising an electrically conductive first spring contactor defining a stationary segment for contact with a substrate and an opposed free segment;

wherein said free segment is in biased contact with the first strip and not bonded to the first strip in a completed portable electronic device.

2. The electrical connector of claim 1 wherein the transition element is not fixedly attached to the frame.

3. The electrical connector of claim 1 wherein the exterior surface defines a third sidewall and a fourth sidewall opposed to the third, a first rib extending from the third sidewall and defining a first mounting surface, and a second rib extending from the fourth sidewall and defining a second mounting surface.

4. The electrical connector of claim 1 wherein the frame further defines an electrically conductive second strip disposed on at least a portion of the exterior surface, wherein the first strip is electrically isolated from the second strip within the confines of the frame.

5. The electrical connector of claim 4 wherein the transition element further comprises an electrically conductive second spring contactor defining a stationary segment for contact with a substrate and an opposed free segment biased to contact the second strip, wherein the first spring contactor is electrically isolated from the second spring contactor within the confines of the transition element.

6. An electrical connector for a portable electronic device comprising:

a frame defining at least two planar exterior surfaces and an electrically conductive first strip disposed on at least a portion of each of the two planar exterior surfaces, and a transition element comprising an electrically conductive first spring contactor defining a stationary segment for contact with a substrate and an opposed free segment biased for contact with the first strip.

7. The electrical connector of claim 6 wherein the first strip is disposed on a rear wall opposite a receptacle opening and a first sidewall.

8. The electrical connector of claim 7 wherein the exterior surface further defines a lip extending from the rear wall, and the first strip is further disposed on at least a portion of the lip.

9. The electrical connector of claim 7 wherein the first strip is further disposed on at least a portion of a second sidewall that is opposed to the first sidewall.

10. An electrical connector for a portable electronic device comprising:

a frame defining an exterior surface and an electrically conductive first strip disposed on at least a portion of the exterior surface, and a transition element comprising an electrically conductive first spring contactor defining a stationary segment for contact with a substrate and an opposed free segment biased for contact with the first strip, wherein the exterior surface defines a third sidewall and a fourth sidewall opposed to the third, a first rib extending from the third sidewall and defining a first mounting surface, and a second rib extending from the fourth sidewall and defining a second mounting surface, the electrical connector in combination with a substrate, wherein the first and second mounting surfaces are in contact with a surface of the substrate that defines a plane that passes through the rear wall of the frame.

11. The electrical connector of claim 10 wherein the plane is perpendicular to the third and fourth sidewalls.

12. In a portable electrical device comprising a printed wiring board (PWB) and a female electrical receptacle defining a receptacle opening for receiving a complementary plug and a rear wall opposing the receptacle opening, the improvement comprising:

a first and second conductive strip each disposed on at least a portion of the rear wall and not in direct contact with each other, and a first and second spring contactor each defining a fixed segment and a free segment, wherein at least a portion of each fixed segment is in electrical contact with the printed wiring board, the first spring contactor free segment is in biased contact with and not bonded to the first conductive strip, the second spring contactor free segment is in biased contact with and not bonded to the second conductive strip, and the first and second spring contactors are not in direct contact with each other.

13. In a portable electrical device comprising a printed wiring board PWB and a female electrical receptacle defining a receptacle opening for receiving a complementary plug and a rear wall opposing the receptacle opening, the improvement comprising:

a first and second conductive strip each disposed on at least a portion of the rear wall and on at least a portion of a lip extending from the rear wall, said first and second conductive strips not in direct contact with each other, and a first and second spring contactor each defining a fixed segment and a free segment, wherein at least a portion of each fixed segment is in electrical contact with the printed wiring board, the first spring contactor free segment is biased to contact the first conductive strip, the second spring contactor free segment is biased to contact the second conductive strip, and the first and second spring contactors are not in direct contact with each other.

14. In a portable electrical device comprising a printed wiring board PWB and a female electrical receptacle defining a receptacle opening for receiving a complementary plug, a rear wall opposing the receptacle opening, and a sidewall adjacent to the rear wall, the improvement comprising:

a first and second conductive strip each disposed on at least a portion of the rear wall, at least one of said first and second strips disposed on at least a portion of the sidewall, wherein said first and second conductive strips are not in direct contact with each other, and a first and second spring contactor each defining a fixed segment and a free segment, wherein at least a portion of each fixed segment is in electrical contact with the printed wiring board, the first spring contactor free segment is biased to contact the first conductive strip, the second spring contactor free segment is biased to contact the second conductive strip, and the first and second spring contactors are not in direct contact with each other.

15. In a portable electrical device of comprising a printed wiring board PWB, and a female electrical receptacle defining a receptacle opening for receiving a complementary plug and a rear wall opposing the receptacle opening, the improvement comprising:

a first and second conductive strip each disposed on at least a portion of the rear wall and not in direct contact with each other, and a first and second spring contactor each defining a fixed segment and a free segment, wherein at least a portion of each fixed segment is in electrical contact with the printed wiring board, the first spring contactor free segment is biased to contact the first conductive strip, the second spring contactor free segment is biased to contact the second conductive strip, and the first and second spring contactors are not in direct contact with each other; and wherein a plane defined by a major surface of the PWB intersects the rear wall.

16. In a portable electrical device comprising a printed wiring board PWB and a female electrical receptacle defining a receptacle opening for receiving a complementary plug and a rear wall opposing the receptacle opening, the improvement comprising:

a first and second conductive strip each disposed on at least a portion of the rear wall and not in direct contact with each other, and a first and second spring contactor each defining a fixed segment and a free segment, wherein at least a portion of each fixed segment is in electrical contact with the printed wiring board, the first spring contactor free segment is biased to contact the first conductive strip, the second spring contactor free segment is biased to contact the second conductive strip, and the first and second spring contactors are not in direct contact with each other wherein the female electrical receptacle further defines two opposed sidewalls adjacent to the rear wall, a rib defining a mounting surface extending from each of the two sidewalls, and wherein the mounting surfaces abut a major surface of the PWB.

17. A method of connecting an electrical connector to a printed wiring board comprising the steps of:

(a) providing a printed wiring board (PWB);

(b) fixedly attaching a transition element of the electrical connector to the PWB; and (c) attaching a frame of the electrical connector to a housing of an electronic device:

(d) bringing the housing and PWB together so that a conductive strip disposed on at least a portion of an exterior surface of the frame is in biased contact with a free end of the transition element.

18. The method of claim 17 wherein the device is an electronic device from the group consisting of: a mobile terminal, a mobile telephone, a personal electronic organizer, a portable music player, a digital camera, a camcorder and a portable computer.

19. The method of claim 17 wherein the electrical connector is a female electrical receptacle for charging a battery that provides portable power to the device.

20. The method of claim 17 wherein the free end of the transition element and the conductive strip of the frame remain in direct contact in a completed electrical device only by the biased contact.

* * * * *